United States Patent [19]

Marchesini

[11] Patent Number: 4,693,510

[45] Date of Patent: Sep. 15, 1987

[54] FOLDING CHAIR

[75] Inventor: Sisto Marchesini, Montecchio Maggiore Vicenza, Italy

[73] Assignee: ICU Intercommerz Union S.A., Riva San Vitale, Switzerland

[21] Appl. No.: 918,688

[22] Filed: Oct. 14, 1986

Related U.S. Application Data

[63] Continuation of Ser. No. 594,668, Mar. 28, 1984, abandoned.

[30] Foreign Application Priority Data

Mar. 28, 1983 [IT] Italy ..... 21298/83[U]

[51] Int. Cl.[4] ..... A47C 4/30; A47C 4/44

[52] U.S. Cl. ..... 297/39; 297/441; 297/457

[58] Field of Search ..... 297/39, 31, 382, 441, 297/457

[56] References Cited

U.S. PATENT DOCUMENTS

| | | | |
|---|---|---|---|
| 1,933,040 | 10/1933 | Baker | 297/31 X |
| 1,989,203 | 1/1935 | Larsen | 297/441 |
| 2,275,908 | 3/1942 | Kelly | 297/441 X |
| 2,652,882 | 9/1953 | Kotler | 297/21 X |
| 2,783,825 | 3/1957 | Guttings et al. | 297/39 |
| 3,698,766 | 10/1972 | Borenstein | 297/443 X |
| 3,981,538 | 9/1976 | Chubb | 297/454 |

FOREIGN PATENT DOCUMENTS

| | | | |
|---|---|---|---|
| 1144462 | 10/1957 | France | 297/39 |
| 1417366 | 10/1965 | France | 297/441 |
| 2176421 | 10/1973 | France . | |
| 2500286 | 8/1982 | France . | |
| 610700 | 10/1960 | Italy | 297/441 |
| 269753 | 7/1950 | Switzerland | 297/39 |
| 392680 | 5/1933 | United Kingdom . | |
| 419243 | 11/1934 | United Kingdom | 297/39 |
| 762558 | 11/1956 | United Kingdom . | |
| 1086394 | 10/1967 | United Kingdom | 297/441 |
| 1181690 | 2/1970 | United Kingdom . | |
| 1359249 | 7/1974 | United Kingdom . | |

*Primary Examiner*—Kenneth J. Dorner
*Assistant Examiner*—Peter R. Brown
*Attorney, Agent, or Firm*—Fleit, Jacobson, Cohn & Price

[57] ABSTRACT

A folding chair comprising first and second metal frames defining seat and backrest parts, which frames are hinged together and to supporting legs; seat and backrest fabric portions stretched over said first and second frames, and an elastic or elastomeric fabric strip connected to said fabric portions and folded around a transversal rear element of first frame to keep the chair fabric taut.

10 Claims, 4 Drawing Figures

FOLDING CHAIR

This application is a continuation of application Ser. No. 594,668, filed Mar. 28, 1984, now abandoned.

BACKGROUND OF THE INVENTION

This invention refers to folding chairs, armchairs or the like and, in particular, to a folding chair of the type in which a first and a second metal frame, between which a length of fabric or the like defining the surface of the seat and backrest is stretched, are linked together and are supported by legs which are hinged to one or both of the frames and to lateral tip-up armrests. As is known, in chairs or armchairs of the aforementioned type, the fabric defining the surface of the seat and backrest is stretched by means of appropriate lateral springs which hook onto the rear of the chair frame. Besides being a rather unattractive solution, the use of external springs for stretching the fabric gives rise to problems as, with the passing of time, the springs tend to spring out of shape and come unhooked, and involve higher manufacturing costs and longer assembling times; moreover, should one of the springs break or be lost the chair would no longer be usable.

The scope of this invention is to provide a folding chair, of the aforementioned type, which is capable of overcoming the above problems.

A further scope of the invention is to provide a folding chair which is optionally provided with a special locking catch which automatically holds the chair open, thus preventing it from accidentally folding up due to improper use.

SUMMARY OF THE INVENTION

According to one aspect of this invention, a folding chair is thus provided, of the type comprising a first metal frame defining the seat, and a second metal frame defining the backrest, which are hinged together and to supporting legs in order to permit the opening and closing of the chair, and a fabric, or the like, stretched over the aforesaid frames, characterized by the fact that an elastic or elasticized fabric strip extends to the rear of seat and backrest fabric portions, said fabric strip being folded around a rear transversal element of said first frame, and being fastened by its edges to said seat and backrest portions of said fabric in order to keep the latter constantly taut. The chair according to this invention will be described in greater detail hereunder, with reference to the accompanying drawings, in which:

DESCRIPTION OF THE INVENTION

Figure 1:
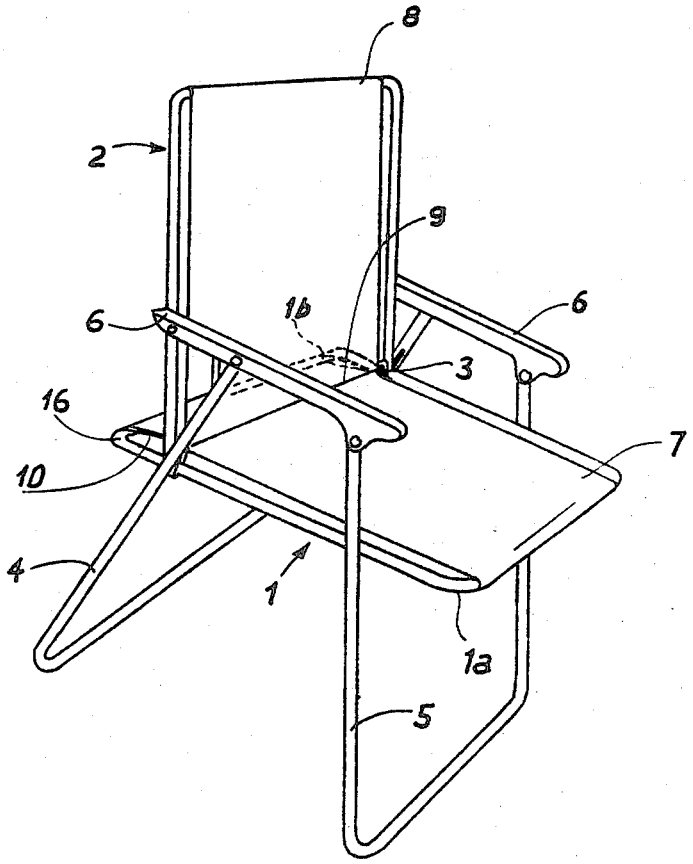
FIG. 1 shows a perspective view of a folding chair, embodying the invention.

FIG. 1 shows a generic folding chair or armchair, of the type comprising a first tubular metal frame 1, defining for example the seat frame, and a second tubular metal frame 2, defining for example the backrest frame; said frames 1 and 2 are hinged together and to the legs 4 and 5 by means of lateral pins 3 as shown, said legs comprising an upward extension which hinges onto tip-up armrests 6 linked to frame 2, so as to permit the opening and, respectively, the closing of the chair.

Secured to the chair frames 1 and 2 is a length of fabric, plastic or other material, designed to define portion 7 of the seat and, respectively, portion 8 of the backrest, which are orientated in different planes connected in correspondence with the dividing line 9. Reference 10 in FIG. 1 indicates a folded strip of elastic or elasticized fabric which is sewn along its longitudinal edges 10*a* and 10*b* (FIG. 2) to the seat and backrest portions 7 and 8, astride the dividing line 9; the strip 10 is folded around and stretched by a transversal retaining element 1*b* constituting part of the frame 1 of the chair seat.

Figure 2:
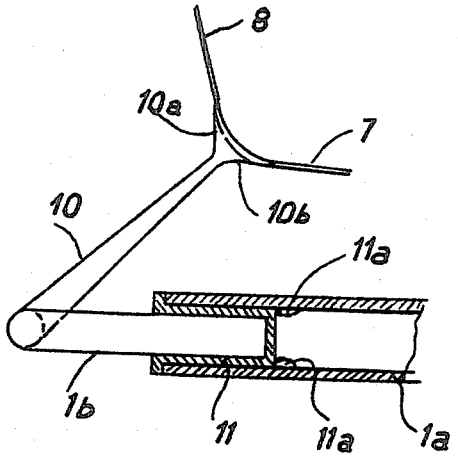
FIG. 2 shows an enlarged detail of the chair of FIG. 1.

In particular, as shown by FIGS. 1 and 2, the frame 1 of the seat comprises a front portion 1*a*, consisting of a U-shaped tubular element, the lateral arms of which are hinged to the legs 4 and 5 of the chair, and of a rear portion 1*b*, consisting of a U-shaped tubular element, the ends of which are bent and penetrate into dead end bushes 11 inserted or forced into the ends of the tubular arms of said frame part 1*a*; protrusions 11*a*, inside the tube, may be provided in place of the bush 11. The length of the bent ends of the transversal element 1*b* and the length of the elastic strip 10 must be sufficient to ensure that the strip 10 is always kept reasonably taut in order to keep the transversal retaining element 1*b* constantly inserted in the lateral arms of the frame portion 1*a*. This solution, together with the use of a folded elastic strip to keep the fabric 7, 8 of the chair under tension, has made it possible to achieve an embodiment which is extremely simple and easy to assemble, as it is sufficient to push the tubular element 1*b* through the loop in the strip 10 and insert its ends into bushes 11 inside the two arms of the seat frame 1*a*. The strip 10 may either be in one piece and be substantially of the same width as the chair fabric, or may be divided into two or more parts at a distance from one another.

Figure 3:
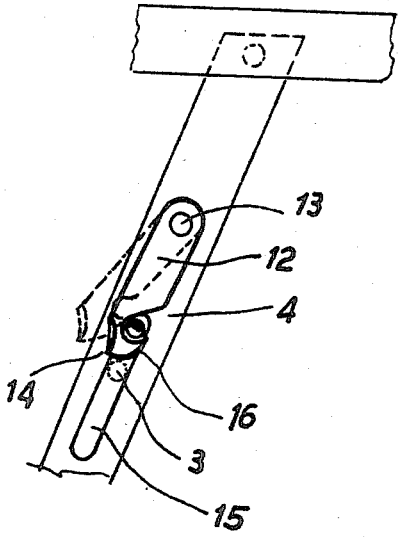
FIGS. 3 and 4 show a front view and a side view of a hooking device for locking the chair in its open position.
Figure 4:
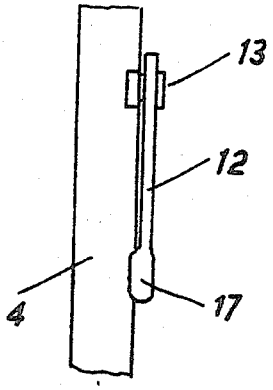

FIGS. 3 and 4 of the drawings show a further feature of the folding chair, consisting of a hook or safety catch which engages automatically when the chair is opened and which prevents the chair itself from accidentally re-closing.

The aforementioned locking device comprises a hooking element 12, hinged at 13, onto one side of a rear leg 4 and presents its free end 14 suitably hook-shaped in order to engage with a hinge pin 3 or the like, on the frame of the seat and/or backrest of the chair; the pin 3 slides, in a per sè known way, in a lateral slot 15 on the inner side of the leg 4.

As shown in the figures, the edge of the end 14 of the hooking element which faces towards the pin 3, is cam-shaped, or suitably curved or chamfered, so that the action of the pin 3 upon edge 16 of the hooking element, as the pin 3 slides upwards along the slot 15 to open the chair, automatically shifts the hooking element 12 to one side (towards the left as shown by the dotted lines) and the element 12 then drops down, under its own weight, (turning towards the right in FIG. 2) as soon as the pin 3 passes the point of the hook-shaped end of the aforesaid hooking element 12. In this way, the element 12 automatically hooks onto the hinge pin 3, preventing the latter from sliding downwards and consequently preventing the chair from closing. To close the chair, the hooking element 12 is disengaged from the pin 3 by rotating the element 12 in the opposite direction to before, by hand, or by inclining the chair backwards. The hooking element 12 is kept aligned in the proper position, with respect to the slot 15, by a lateral tongue 17, opposite to cam 16, made by bending the edge of the element itself which engages with the rear leg 4.

What is claimed is:

1. In a folding chair including a first metal frame defining the seat and a second metal frame defining the backrest, said frames being hinged together and to supporting legs to permit the opening and closing of the chair, and seat and backrest portions of fabric or the like having outer ends connected to ends of the aforesaid frames, wherein the improvement comprises a transverse retaining element positioned rearwardly of said seat and having ends received in said seat frame, said seat and backrest fabric portions each having inner ends connected together at a common junction intermediate the outer ends thereof, and a unitary elongated elastic strip having a width substantially equal to the width of the seat and backrest fabric and extending across said fabric portions adjacent said common junction and having a first end secured directly to said seat fabric portion and a second end secured directly to said backrest fabric portion, said strip passing over a portion of the surface of and around said transverse retaining element and being under tension between said first and second ends thereof to keep the seat and backrest fabric portions taut to define substantially planar seat and backrest portions when the chair is unfolded to an open position, said strip positioned to extend at an obtuse angle with the planes of each of said seat and backrest fabric portions when the chair is unfolded to an open position to maintain each of the seat and backrest fabric portions in a taut condition.

2. A chair as claimed in claim 1, in which said first frame comprises a pair of U-shaped structures having tubular legs, one of said U-shaped structures defining said transverse retaining element and having bent ends slidably penetrating into corresponding bent ends of the other U-shaped structure.

3. A chair as claimed in claim 2, in which the ends of the seat frame include stopping means for the bent ends of the transverse retaining element.

4. A chair as claimed in claim 3, in which said stopping means are defined by dead end bushes inserted into the ends of the arms of said opposite U-shaped structure.

5. A chair as claimed in claim 3, in which said stopping means are defined by inwardly extending protrusions inside the tubular ends of the arms of said opposed U-shaped structure.

6. In a folding chair including a first metal frame defining the seat and a second metal frame defining the backrest, said frames being hinged together and to supporting legs to permit the opening and closing of the chair, and seat and backrest portions of fabric or the like having outer ends connected to ends of the aforesaid frames, wherein the improvement comprises a transverse retaining element positioned rearwardly of said seat and having ends received in said seat frame, said seat and backrest fabric portions each having inner ends connected together at a common junction intermediate the outer ends thereof, and a unitary elongated elastic strip having a width substantially equal to the width of the seat and backrest fabric and extending across said fabric portions adjacent said common junction and having first and second edges secured directly to one of said fabric portions, said strip passing over a portion of the surface of and around said transverse retaining element and being under tension between said retaining element and said first and second edges thereof to keep the fabric portions taut to define substantially planar seat and backrest portions when the chair is unfolded to an open position, said strip positioned to extend at an obtuse angle with the planes of each of said seat and backrest fabric portions when the chair is unfolded to an open position to maintain each of the seat and backrest fabric portions in a taut condition.

7. A chair as claimed in claim 6, in which said first frame comprises a pair of U-shaped structures having tubular legs, one of said U-shaped structures defining said transverse retaining element and having bent ends slidably penetrating into corresponding bent ends of the other U-shaped structure.

8. A chair as claimed in claim 7, in which the ends of the seat frame include stopping means for the bent ends of the transverse retaining elements.

9. A chair as claimed in claim 8, in which said stopping means are defined by dead end bushes inserted into the ends of the arms of said opposite U-shaped structure.

10. A chair as claimed in claim 8, in which said stopping means are defined by inwardly extending protrusions inside the tubular ends of the arms of said opposed U-shaped structure.

* * * * *